US005772541A

United States Patent [19]

Buiatti

[11] Patent Number: 5,772,541

[45] Date of Patent: Jun. 30, 1998

[54] VIBRATION DAMPENED HAND-HELD IMPLEMENTS

[75] Inventor: John Buiatti, Castaic, Calif.

[73] Assignee: Jas D. Easton, Inc., Van Nuys, Calif.

[21] Appl. No.: 847,180

[22] Filed: May 1, 1997

[51] Int. Cl.[6] ..... A63B 59/00

[52] U.S. Cl. ..... 473/520; 473/519; 473/521; 473/564; 473/549; 473/297; 124/23.1

[58] Field of Search ..... 473/519, 520, 473/521, 523, 297, 564, 549; 124/23.1, 25.6

[56] References Cited

U.S. PATENT DOCUMENTS

| | | | |
|---|---|---|---|
| 3,757,761 | 9/1973 | Izuta | 124/23.1 |
| 4,811,947 | 3/1989 | Takatsuka et al. | 473/523 |
| 5,088,734 | 2/1992 | Glava | 473/523 |
| 5,180,163 | 1/1993 | Lanctot et al. | 473/520 |
| 5,183,264 | 2/1993 | Lanctot | 473/520 |
| 5,244,209 | 9/1993 | Benzel | 473/297 |
| 5,362,046 | 11/1994 | Sims . | |
| 5,624,114 | 4/1997 | Kelsey | 473/520 |
| 5,653,643 | 8/1997 | Falone et al. | 473/523 X |
| 5,655,980 | 8/1997 | Nashif et al. | 473/520 |
| 5,692,971 | 12/1997 | Williams | 473/520 X |

FOREIGN PATENT DOCUMENTS

| | | | |
|---|---|---|---|
| 15733 | 12/1933 | Australia | 473/183 |

*Primary Examiner*—Raleigh W. Chiu
*Attorney, Agent, or Firm*—Roth & Goldman

[57] ABSTRACT

A vibration dampened hand held implement such as a ball bat, archery bow or hammer is provided with a vibration dampening system comprising a chamber having a low modulus viscoelastic elastomeric vibration dampening member freely moveable therein to bounce back and forth between and move out of phase with the chamber walls to rapidly dampen unwanted lower frequency vibrations of the implement.

13 Claims, 6 Drawing Sheets

FIG. 1
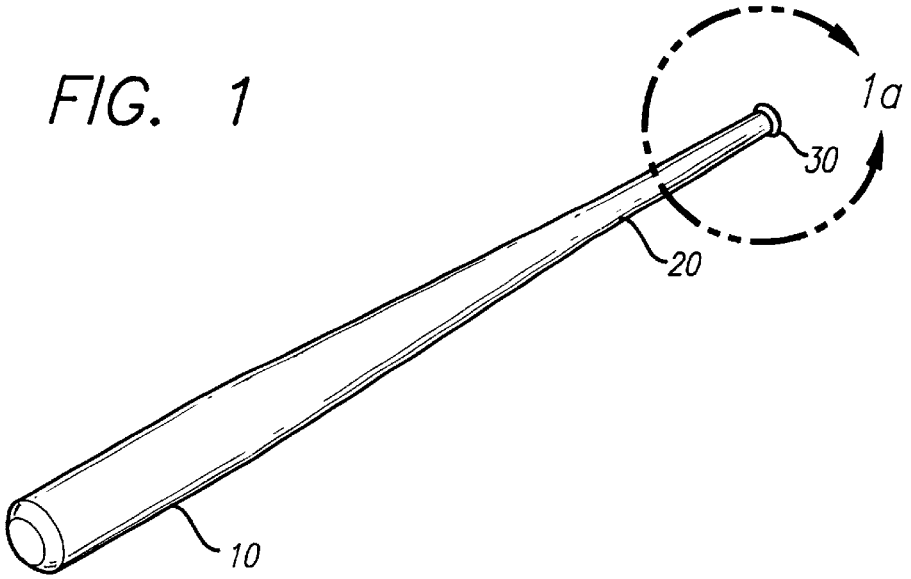
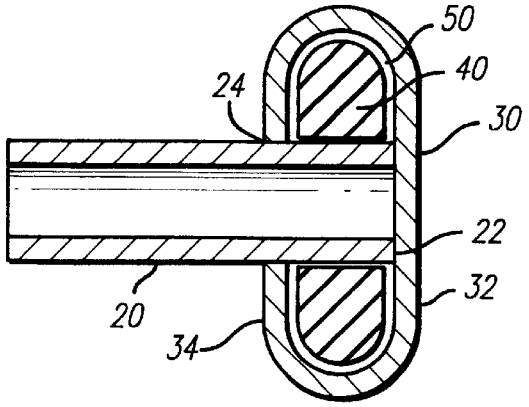
FIG. 1a
FIG. 2
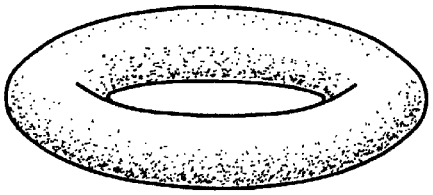

VIBRATION DAMPENED HAND-HELD IMPLEMENTS

CROSS REFERENCE TO RELATED APPLICATIONS

None

BACKGROUND OF THE INVENTION AND PRIOR ART

1. Field of the Invention

The present invention relates to the dampening or rapid elimination of unwanted vibrations or sting to the user's hands in hand held implements such as sports implements and impact hand tools such as hammers. The invention will be described with particular reference to sports implements such as baseball bats and archery bows but, in its broadest aspects, the invention has application to non-sports implements as well.

The sting of a baseball bat on the batters hands is a well known phenomenon which is most acute in cold weather conditions whenever the ball is hit at a location on the bat close to the users hands. The sting is due to unwanted transient vibrations which occur during normal use of most sporting equipment. This is especially the case for impact equipment such as baseball bats, tennis and squash rackets and the like whenever the ball is not hit within the optimum zone or "sweet spot" of the implement. Undesirable vibrations also occur during normal use of non-impact sports equipment such as archery bows.

As is well known, vibrations imparted to a baseball bat by a ball or to an archery bow during release of an arrow are transmitted to the user's hands. This will at a minimum exacerbate hand fatigue, or result in deceleration of the implement with resultant loss of power (bat deceleration or "check swing" in baseball) due to apprehension of the impending sting associated with a mis-hit. The problem is especially pronounced with younger and less experienced players resulting in diminished confidence.

In the case of archery bows, though not painful, the vibrations contribute to fatigue and may be unduly noisy. In a hunting situation, the noise of the vibrations of the reverberating bow limbs and bowstring when a shot is missed alerts game to the presence of the hunter usually precluding a follow up shot. If the game is struck, the sounds may either cause the animal to run farther before perishing, or in the case of dangerous game, invoke a charge.

2. Prior Art

Wooden ball bats for softball and baseball are well known as are more recently developed durable metal bats. Metal ball bats are distinctly advantageous in that, while more expensive to manufacture, they are less subject to breakage and can therefore be used repeatedly with consequent cost savings. Metal bats have a larger "sweet spot" and generally perform better than wood and have been found acceptable at levels from Little League up through college baseball.

One example of a vibration dampened ball bat is shown in U.S. Pat. No. 5,362,046 issued Nov. 8, 1994 to Steven C. Sims. That patent discloses an elastomeric member generally of a mushroom shape having its stem end firmly attached to the handle end of a baseball bat or golf club or the like such that the only part of the stem and the head of the elastomeric vibration dampening member vibrate, and such vibration is free from contact with the implement. During vibration the head is free to tilt such that the edge of the head moves generally parallel to the longitudinal axis of sports implement as the as the head generally moves transversely to the longitudinal axis of the sports implement.

The major drawback of such a system is the inefficiency associated with having part of the system's mass, the stem in the previously mentioned device, not directly contributing to the dissipation of the unwanted vibrational energy. Additionally, that system can be potentially more expensive and complicated to implement or manufacture.

Although the present invention was developed during research in the field of ball bats such as baseball or softball bats, the teachings herein are also applicable to many other types of articles for impacting balls or other objects in sports and also to non-impacting sports implements such as archery bows as well.

OBJECT OF THE INVENTION

The primary object of the present invention is to provide an efficient and inexpensive means of dampening unwanted vibrations imparted to the hands of a user which contact a baseball bat, tennis racket, squash racket, archery bow or any other vibration inducing object to quickly damp the unwanted vibrations to minimize the transmission thereof to the users hands.

SUMMARY OF THE INVENTION

The present invention accordingly provides an implement having a handle which, during use is subject to vibration in at least one direction transverse to a longitudinal axis of said handle, and a vibration dampening system mounted on said implement, characterized in that said vibration dampening system comprises a chamber on said implement proximate a location of maximum transverse displacement of a point on said implement during vibration and an elastomeric member disposed in said chamber, said elastomeric member being freely moveable in said chamber by contact with walls of said chamber in at least one direction transverse to said longitudinal axis.

The system described herein is among the most efficient (on a damping factor to weight ratio) systems yet devised. It is comprised of the minimum number of components thereby also making it the simplest. The present invention is designed to selectively dissipate the lower unwanted frequencies which may be in the order of 200 Hz for the first bending mode in a baseball bat and in the order of 600 Hz for the second bending mode of the bat along its longitudinal axis. Other higher order frequency vibrations such as those in the 1500–2000 Hz range, resulting from radial deflection of the barrel of the bat during impact with the ball are substantially unaffected by the dampening system of the present invention. These higher frequency vibrational modes in impact type sports implements (bats, golf shafts, etc.) are of consequently lower amplitudes and do not result in any significant feeling or discomfort to the user. Furthermore, any dissipation of these higher frequency/lower amplitude modes often results in hampered impact performance.

BRIEF DESCRIPTION OF THE DRAWINGS

FIG. 1 is a perspective view of a baseball or softball bat.

FIG. 1*a* is a cross sectional view to an enlarged scale of a first embodiment of the invention.

FIG. 2 is a perspective view of a vibration dampening member used in the embodiment of FIG. 1.

DESCRIPTION OF THE PREFERRED EMBODIMENT

Figure 3:
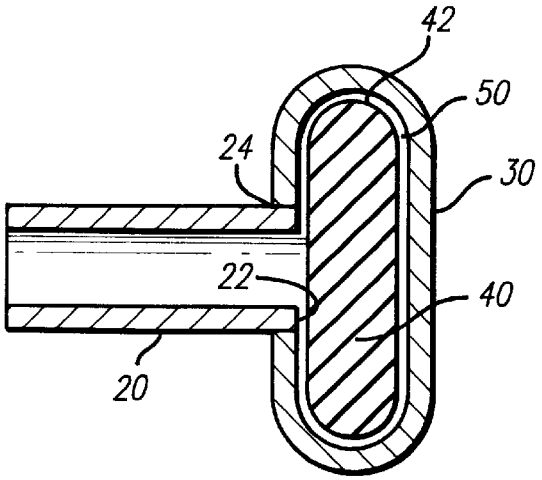
FIG. 3 is a cross sectional view to an enlarged scale of a second embodiment of the invention.

FIG. 1 shows a typical baseball bat 10 having a handle 20 and knob 30 affixed to the end 22 thereof. Although the invention will be described in conjunction with hollow metallic baseball bats, it will be appreciated that the teachings of the invention are generally applicable to other types of hand held implements including solid wood bats, golf clubs, archery bows, hammers, and the like, as well.

The enlarged section of the handle end of the bat shown in FIG. 1*a* shows a hollow aluminum bat handle 20 having an aluminum knob 30 affixed by conventional methods over the end thereof as by an circular weld at the joint 24. As shown, the inner handle end 22 of the bat abuts the inner face of the end wall 32 of the knob.

A system for damping bat vibration is mounted on the bat proximate a location of maximum transverse displacement of a point on the bat during vibration, which, as shown, comprises the handle end of the bat. The vibration dampening system comprises a generally torroidal shaped elastomeric vibratory or oscillatory member 40, having a Shore durometer hardness in the range of from about 5 A–60 D, positioned in a chamber 50 formed between the knob 30 and the handle 20 of the bat. As shown, the torroidal member 40 preferably has a rounded exterior surface of slightly less outside diameter than the interior diameter of the knob and an annular cylindrical inner surface of diameter slightly greater than the outside diameter of the bat handle 20 so as to leave a clearance space in chamber 50 all around the elastomeric member 40 to permit free movement of the elastomeric member 40 in at least one and preferably all radial directions as well as axially in the chamber 50 formed in the bat knob, as will be explained in greater detail below.

During manufacture, the knob 30 is first partially formed following which the elastomeric member 40 may be easily positioned in the knob and finally the inner end wall 34 of the knob 30 is bent to form a circular hole of slightly less diameter than the outside diameter of the bat handle 20 so that the knob can be tightly affixed onto the handle end of the bat with abutment of the handle end 22 of the bat against the inner side of the end wall 32 of the knob to provide a secure, non-movable juncture. The joint 24 between the bat handle and knob which surrounds the bat handle may be threaded or welded to provide more secure attachment of the knob 30 to the end of the bat 10 if desired. Also, if desired, a multi-piece elastomer forming a torroid may be used instead of a single torroidal piece if it is desired to first form the knob 30 substantially to its final configuration and then deform and insert the elastomeric member 40 or pieces thereof in the hole left in the knob.

FIG. 3 discloses a second embodiment of the invention in which the bat handle 20 does not extend interiorly into the knob 30. In this embodiment, the elastomeric member 40 takes the form of a thin disc with rounded edges 42 of outside diameter slightly less than the inside diameter of the knob 30 and of axial length slightly less than the axial length of the chamber 50 inside of the knob so as to provide clearance between the elastomeric member 40 and the knob chamber walls to permit free vibration of the elastomeric member 40 in the knob in all radial and axial directions. Knob 30 is welded or threaded at joint 24 or is otherwise suitably affixed to the end 22 of handle 20 as is conventional.

Figure 4:
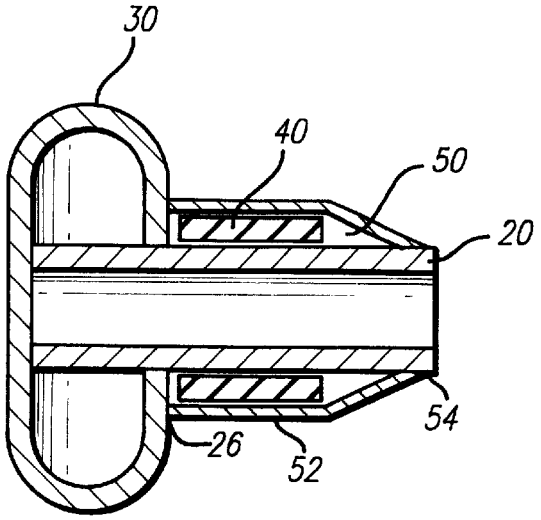
FIG. 4 is a cross sectional view to an enlarged scale of a third embodiment of the invention.

FIG. 4 discloses a third embodiment of the invention having a somewhat different configuration at the knob end. The manner of affixation of the knob 30 to the end of the bat is essentially the same as disclosed in conjunction with the embodiment of FIG. 2; however, a vibration chamber 50 is provided exterior to the bat handle adjacent the knob by a separate sleeve 52 which is first press fit or welded onto the bat handle at joint 54. An elastomeric cylindrical member 40 is then positioned inside the chamber 50 formed between the sleeve 52 and the bat handle 20 leaving clearance in both axial and radial directions to permit free vibration of the elastomeric member 40 in the chamber 50. Finally, the knob 30 is affixed to the end of the bat by welding at joint 26 at the knob end of the sleeve 52.

Figure 5:
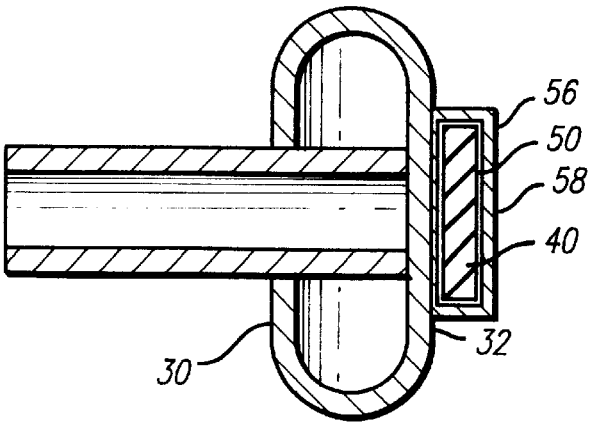
FIG. 5 is a cross sectional view to an enlarged scale of a fourth embodiment of the invention.

FIG. 5 shows a fourth embodiment of the invention in which the vibration dampening system comprises a hollow cylindrically shaped chamber housing 56 having an exterior wall 58, preferably of aluminum, which is provided with a solid cylindrical elastomeric member 40 therein. The chamber housing 56 is affixed to the end wall 32 of the bat knob 30 by welding, threading or adhesive. As in the other embodiments, the vibration chamber 50 in housing 56 is dimensioned to permit free oscillation of the elastomeric member 40 in all axial and radial directions in the chamber 50.

Figure 6:
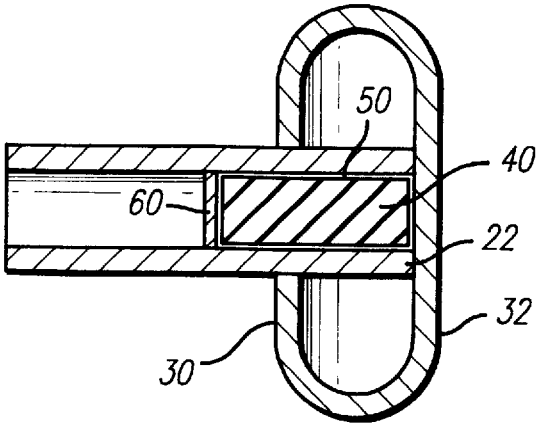
FIG. 6 is a cross sectional view to an enlarged scale of a fifth embodiment of the invention.

FIG. 6 shows a fifth embodiment of the invention in which the vibration dampening elastomeric member 40 is disposed inside the bat handle 20. For this purpose, a metallic retention disc 60 is press fit or otherwise affixed in the inside of the bat handle at a distance spaced from the handle end 22 to permit insertion of a solid cylindrical elastomeric member 40 dimensioned for slight radial and axial clearance to permit radial and axial vibration of member 40 in the chamber 50 in the handle between the disc 60 and inner surface of the end wall 32 of knob 30 which is then affixed to the handle 20 of the bat in any suitable manner as disclosed above.

Figure 7:
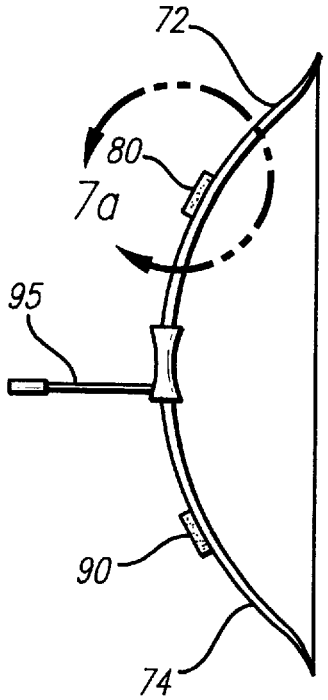
FIG. 7 is a side elevation view of an archery bow provided with a pair of vibration dampening systems mounted thereon.
Figure 7A:
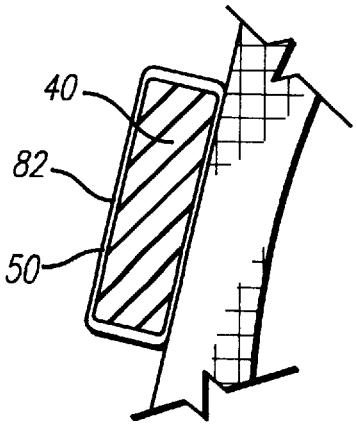
FIG. 7*a* is a section view to an enlarged scale of a vibration dampening system used on the bow of FIG. 7.

FIG. 7 comprises a perspective elevation of a recurve archery bow 70 having a pair of vibration dampening systems 80, 90 affixed to the bow limbs 72, 74, preferably at the anti-nodes or positions of maximum bending deflection of the bow limbs 72, 74 from their normal unbent positions. Since each of the systems 80, 90 is identical, only one will be described. In essence, the vibration dampening system 80 shown to an enlarged scale in FIG. 7*a*, comprises a housing 82 enclosing vibration chamber 50, which is preferably elongated and rectangular to provide a low profile on the bow limbs, the chamber 50 having a thin solid rectangular elastomeric member 40 therein. The interior length, depth, and width of the vibration chamber 50 are slightly greater than the corresponding dimensions of the thin block elastomeric member 40 to permit vibration of member 40 in the chamber 50 in all directions as described above in connection of the ball bat embodiments of the invention. The primary vibrations will be generally transverse to the axis of the limbs 72, 74 of the bow in the plane of the bowstring but each member 40 of elastomeric material in its respective chamber 50 is also free to vibrate in directions generally aligned with the limbs of the bow and in a plane transverse to the limbs of the bow and the plane containing the bowstring. It will be appreciated by those skilled in the art that one or more vibration dampening systems 80, 90 as described herein generally comprising a block of suitable elastomer dimensioned to freely vibrate in an associated vibration chamber, can also or instead be mounted on or near the ends of bow stabilizers or in other locations on a bow which are subject to significant displacement during shooting.

Figure 8:
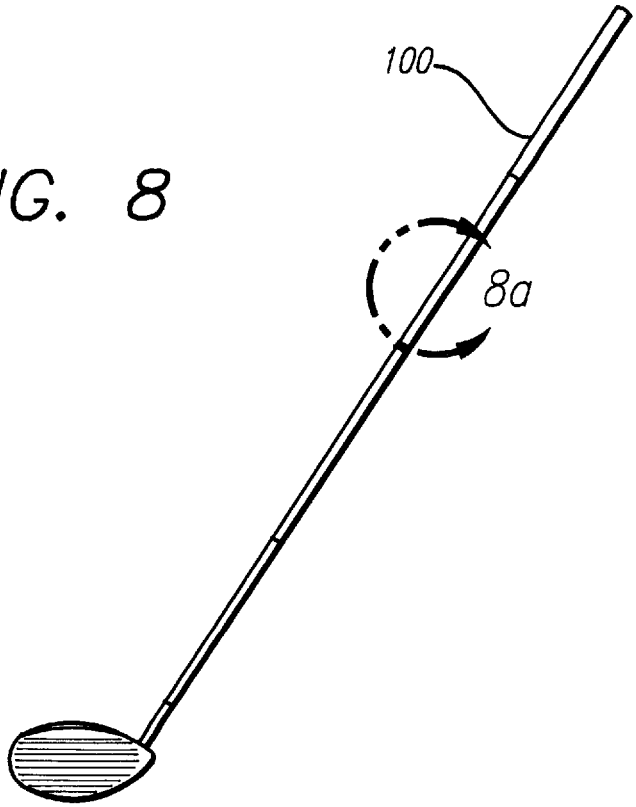
FIG. 8 is a perspective view of a golf club having a vibration dampening system shown to an enlarged scale in FIG. 8*a*.
Figure 8A:
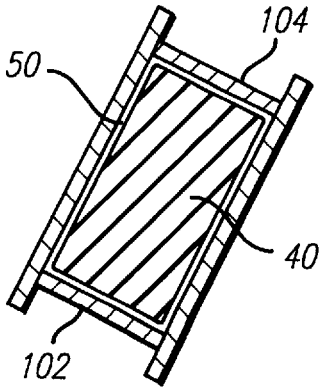

FIG. 8 displays a golf club 100 and FIG. 8*a* shows, to an enlarged scale, a chamber 50 formed between two spaced discs 102, 104 in the interior of the shaft of the golf club containing a solid cylindrical elastomeric member 40 dimensioned to permit vibration of the elastomeric member 40 freely in directions containing the axis of the shaft of the club and in all directions transverse thereto. The vibration dampening chamber 50 and elastomeric member 40 are preferably positioned at the handle end of the club but may instead be positioned below the handle at a location of maximum deflection during the first or second bending modes of the shaft.

In all embodiments, the system is constructed in such a manner that the elastomeric vibration member 40 is alternately accelerated by the equipment in the direction of its oscillation by contact with the trailing and leading surfaces of the chamber 50. When the vibrations of the equipment reverse directions, the elastomeric member 40 moves away due to it's own momentum from the chamber surface against which it had been held, impelling itself or bouncing against the opposing surface, thereby consuming energy through the hysteresic damping property of the elastomeric material. The weight of the elastomeric member 40 relative to the weight of the implement (bat, racquet, hammer, bow, etc.) is small and negligible percentage of the total weight but since the elastomeric member moves out of phase with the vibrations of the chamber walls in which it is positioned and repeatedly contacts those walls, highly efficient vibration damping of the lower unwanted vibration modes is provided.

Figure 9:
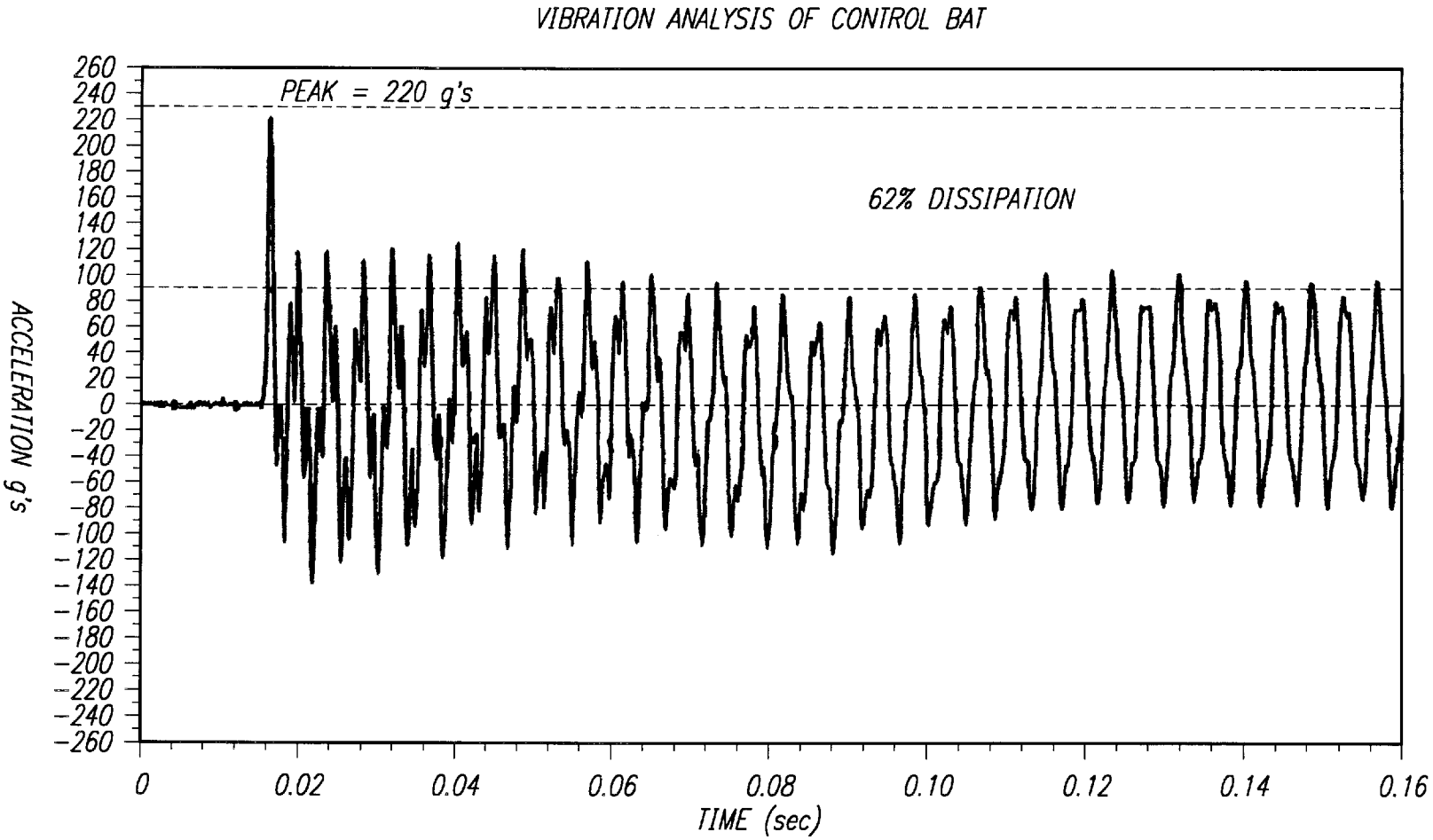
FIGS. 9 and 10 are vibration analysis plots of vibration as a function of time demonstrating the effectiveness of the invention in a ball bat.
Figure 10:
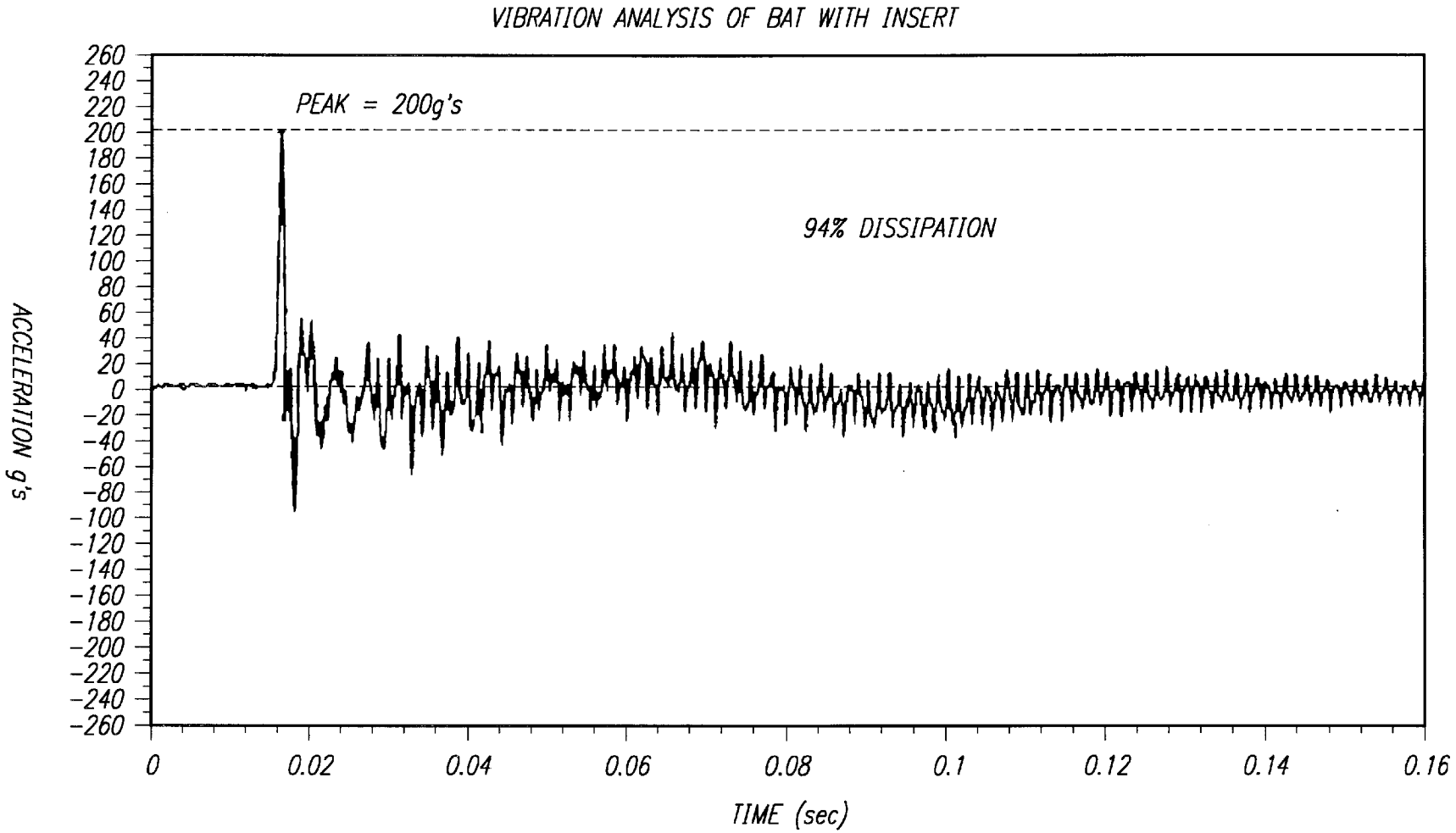

FIGS. 9 and 10 comprise vibration analyses showing vibration dissipation in the handle of a baseball bat as acceleration in g's of a point on the handle plotted against time. The upper portion of the plot represents a hollow aluminum baseball bat which has not been provided with a vibration dampening system according to the teachings of the present invention. The graph is the result of both first and second vibration modes wherein the first vibration mode is of the order of about 180 Hz and the second mode is of the order of about 600 Hz. As shown therein, the handle are not significantly dampened even after a time lapse of about 0.16 seconds (about 29 cycles for first vibration mode and about 96 cycles for second vibration mode). In comparison, the lower portion of the plot shows the vibration dampening in the same type of a baseball bat but which has been provided with a vibration dampening system of the type shown in FIGS. 1*a* and 2 of the drawings. As can be seen therein, vibration is significantly dampened to negligible amplitudes in about 0.02 seconds or less than one eighth the time for vibration dampening in a conventional bat. After only 0.8 seconds, the vibration had been reduced by 94% of its original amplitude as compared with a reduction of only about 65% in an undampened bat.

Persons skilled in the art will readily appreciate that various modifications can be made from the preferred embodiment thus the scope of protection is intended to be defined only by the limitations of the appended claims. For example and without limitation, one or more weighting elements may be added into or combined with the elastomeric vibration member to increase its mass thereby increasing the system's inertia and consequently its effectiveness.

I claim:

1. An implement having a handle which, during use is subject to vibration in at least one direction transverse to a longitudinal axis of said handle, and a vibration dampening system mounted on said implement, characterized in that said vibration dampening system comprises a chamber on said implement proximate a location of maximum transverse displacement of a point on said implement during vibration and an elastomeric member disposed in said chamber, said elastomeric member being freely moveable in said chamber by contact with walls of said chamber in at least one direction transverse to said longitudinal axis.

2. The implement of claim 1, wherein said elastomeric member has a Shore durometer hardness in the range of from 5 A through 60 D.

3. The implement of claim 2, comprising a ball bat having a barrel, a handle and a handle end, and a knob at the end of said handle, said chamber being proximate said knob and said elastomeric member being free to move in all directions transverse to said longitudinal axis.

4. The ball bat of claim 3, wherein said knob surrounds the end of said handle, said chamber is in said knob and said chamber and said elastomeric member are each of generally torroidal configuration.

5. The ball bat of claim 3, wherein said knob is affixed to the end of said handle and said chamber is inside said knob whereby said chamber is axially spaced from the end of said handle and said chamber and said elastomeric member are of generally cylindrical configuration.

6. The ball bat of claim 3, wherein said knob surrounds the end of said handle and said chamber surrounds the end of said handle proximate said knob, said chamber being of generally cylindrical configuration and said elastomeric member being of generally hollow cylindrical configuration.

7. The ball bat of claim 3, wherein said chamber is affixed to an exterior end surface of said knob, said chamber being of generally cylindrical configuration and said elastomeric member being of generally solid cylindrical configuration.

8. The ball bat of claim 3, wherein said bat is hollow, said knob is mounted on the handle end of said bat and said chamber is inside said handle end.

9. The ball bat of claim 8, wherein a portion of said chamber extends inside said knob.

10. The ball bat of claim 3, wherein said elastomeric member is free to move axially in said chamber.

11. The ball bat of claim 3, wherein said bat is made of aluminum or aluminum alloy.

12. The implement of claim 2, comprising an archery bow having a pair of bow limbs and a said vibration dampening system mounted on each bow limb.

13. The implement of claim 2, comprising a golf club.

* * * * *